US007485009B1

(12) United States Patent
Zhu

(10) Patent No.: US 7,485,009 B1
(45) Date of Patent: Feb. 3, 2009

(54) CONTROLLED IMPEDANCE ELECTRICAL CONNECTOR

(75) Inventor: Yu Zhu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/217,967

(22) Filed: Jul. 10, 2008

(30) Foreign Application Priority Data

Jul. 10, 2007 (CN) ..... 2007 2 0040634 U

(51) Int. Cl.
*H01R 24/00* (2006.01)

(52) U.S. Cl. ..... 439/660; 439/444; 439/941

(58) Field of Classification Search ..... 439/682, 439/567, 374, 680, 569, 660, 444, 941
See application file for complete search history.

(56) References Cited

U.S. PATENT DOCUMENTS 5,658,154 A * 8/1997 Bumsted et al. ..... 439/79
6,648,682 B1 * 11/2003 Wu ..... 439/567

FOREIGN PATENT DOCUMENTS

| | | | |
|---|---|---|---|
| CN | 2627667 | Y | 7/2004 |
| TW | M271281 | U | 7/2005 |
| TW | M328683 | U | 3/2008 |

* cited by examiner

*Primary Examiner*—Neil Abrams
*Assistant Examiner*—Phuong Nguyen
(74) *Attorney, Agent, or Firm*—Wei Te Chung

(57) ABSTRACT

An electrical connector (1) comprises a dielectric housing (2) and a plurality of conductive contacts (3) aligned in a line and respectively secured in said dielectric housing (2). Each conductive contact (3) comprises a planar contacting section (30) having a contacting surface adopted to electrically engage a complementary electrical connector, a mounting section (32) adopted to electrically engaging a printed circuit board (5), an intermediate section connecting (34) between the contacting section (30) and the mounting section (32). Wherein, the contacting surfaces of the plurality of conductive contacts (3) are arranged in a common plane having an offset from the printed circuit board (5), the intermediate section (34) defining a hole (36) therein, a proper size conductive region of the intermediate section (34) can be set by defining a proper size of said hole (36).

8 Claims, 6 Drawing Sheets

CONTROLLED IMPEDANCE ELECTRICAL CONNECTOR

BACKGROUND OF THE INVENTION

1. Field of the Invention

The present invention is generally related to the art of electrical connector for use in transmitting high frequency signals and more particularly to matched impedance connectors.

2. Description of Related Art

As an interface for data transfer between a host such as a computer and a hard disk drive (HDD) there usually is employed such a protocol as SCSI (Small Computer System Interface) or ATA (Advanced Technology Attachment) Interface. In particular, from the standpoint of improving the interface function and attaining a reduction of cost, the ATA interface is utilized in many computers and is also widely utilized as an interface in other types of storage devices such as optical disk storage devices. With the demand for improving the recording density and improving the performance, the demand for the data transmission rate of the ATA interface is becoming more and more strict. Therefore, ATA interface (serial ATA) using serial transmission instead of the conventional parallel transmission has been proposed.

A standard for serial ATA is being established by "Serial ATA Working Group." A Serial ATA connector is usually used in transmitting high frequency (for example, 150M~6.0 GHZ) signals. In order for a connector to minimize signal disruption as the signal passes through the connector, it must also have a characteristic impedance at each point along its length which matches the impedance of the transmission line. An impedance mismatch causes severe signal disruption, particularly in high frequency applications.

Usually, a edge of a contact is cut to make a small width which makes a small capacitance and matches the impedance of the transmission line. But a small width will cause low strength which makes the contact being easy to be deformed and further results in defect.

Hence, an improved electrical connector is required to overcome the disadvantages of the prior art.

SUMMARY OF THE INVENTION

Accordingly, an object of the present invention is to provide an electrical connector for use in transmitting high frequency signals and more particularly to match impedance.

In order to achieve the above-mentioned object, an electrical connector comprises a dielectric housing, a set of first conductive contacts aligned in a line and respectively secured in said dielectric housing, and a set of second conductive contacts respectively secured in said dielectric housing and aligned in a line parallel to the line which said first conductive contacts aligned in. Each first conductive contact comprises a planar contacting section having a contacting surface adopted to electrically engage a complementary electrical connector, a mounting section adopted to electrically engaging a printed circuit board, an intermediate section connecting between the contacting section and the mounting section. Each second conductive contact having a thinner width than said first conductive contact. Wherein, the contacting surfaces of the plurality of first conductive contacts are arranged in a common plane having an offset from the printed circuit board, the intermediate section defining a hole therein, a proper size conductive region of the intermediate section can be set by defining a proper size of said hole.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
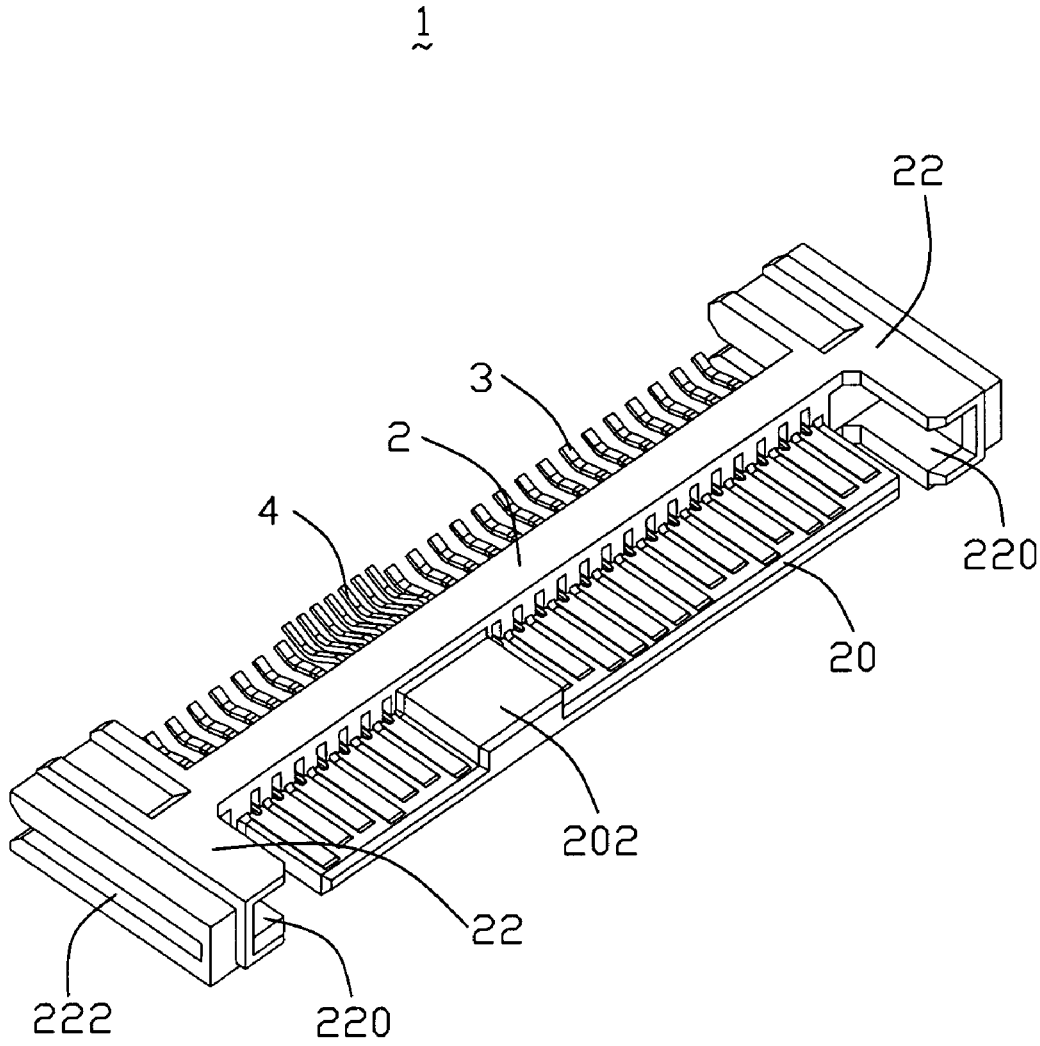
FIG. 1 is an assembled, perspective view of the electrical connector of a preferred first embodiment of the present invention.

Referring to FIG. 1, an electrical connector 1 of a preferred first embodiment of the present invention comprises an elongate dielectric housing 2 and a plurality of conductive contacts 3, 4 respectively secured in the dielectric housing 2.

Figure 2:
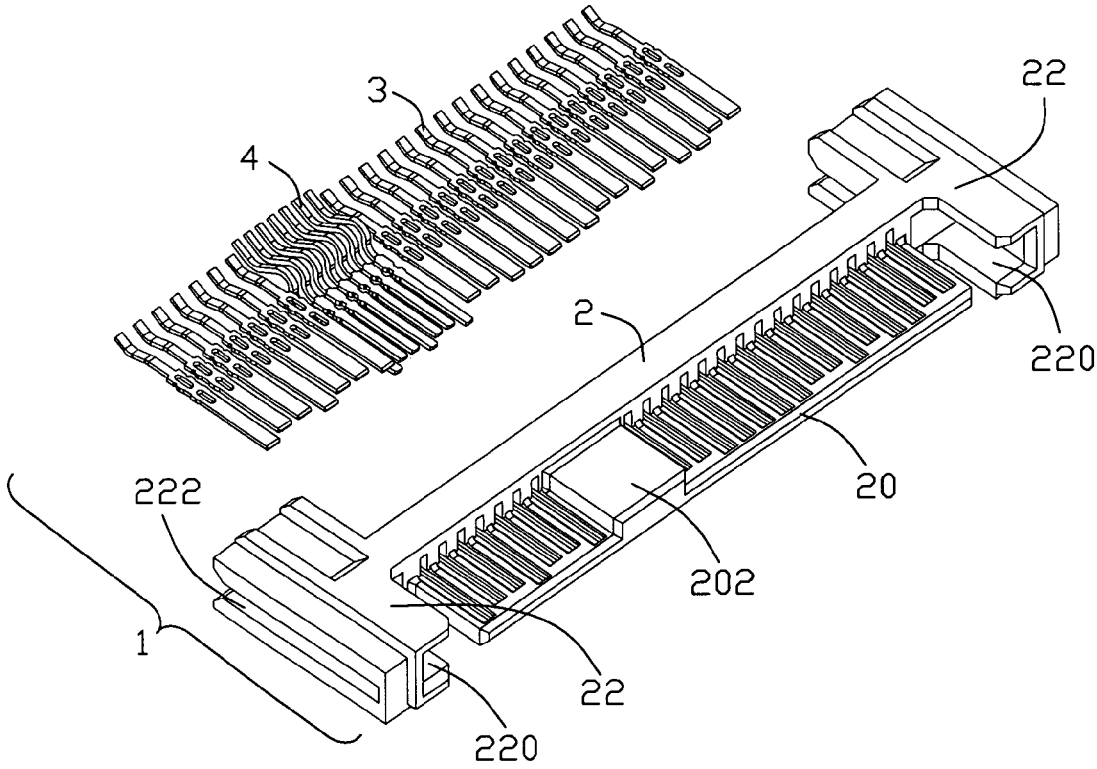
FIG. 2 is an explored, perspective view of the electrical connector as shown in FIG. 1.
Figure 3:
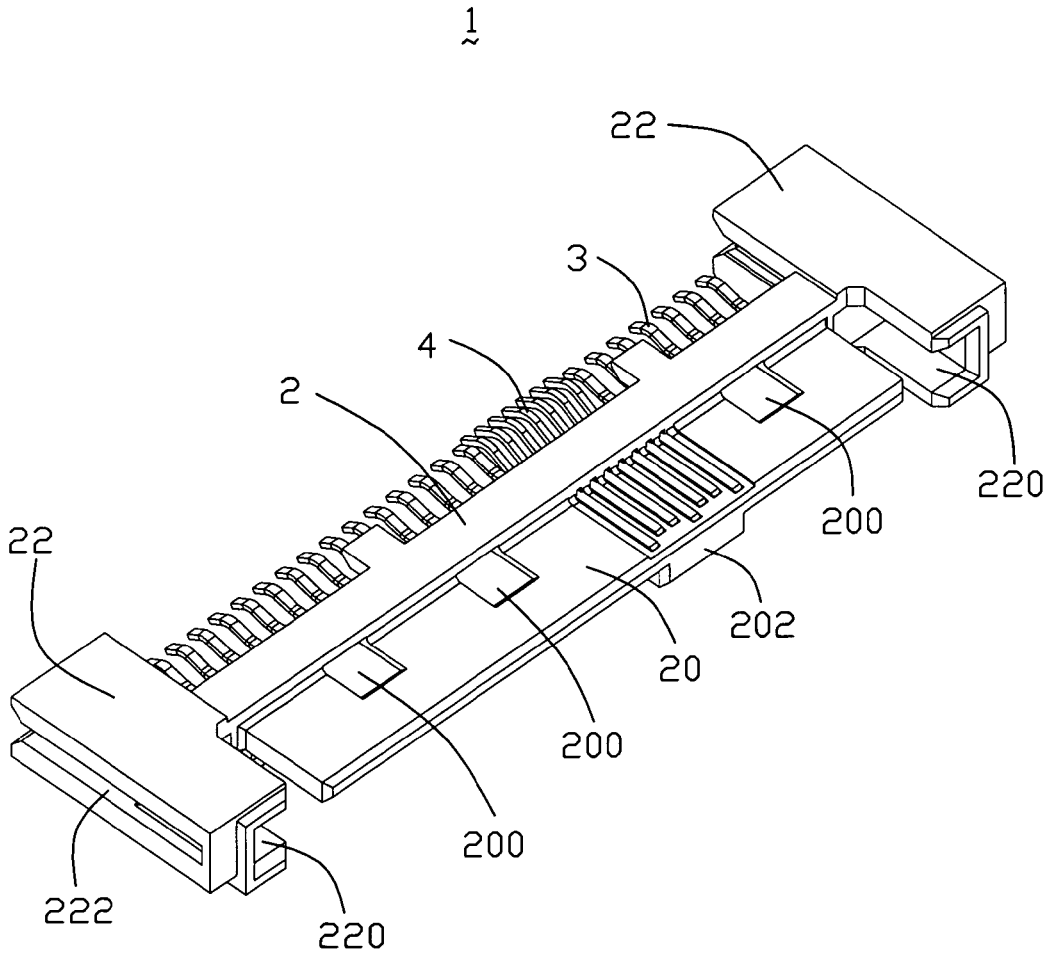
FIG. 3 is a perspective view of the electrical connector as shown in FIG. 1, viewed from another direction.
Figure 4:
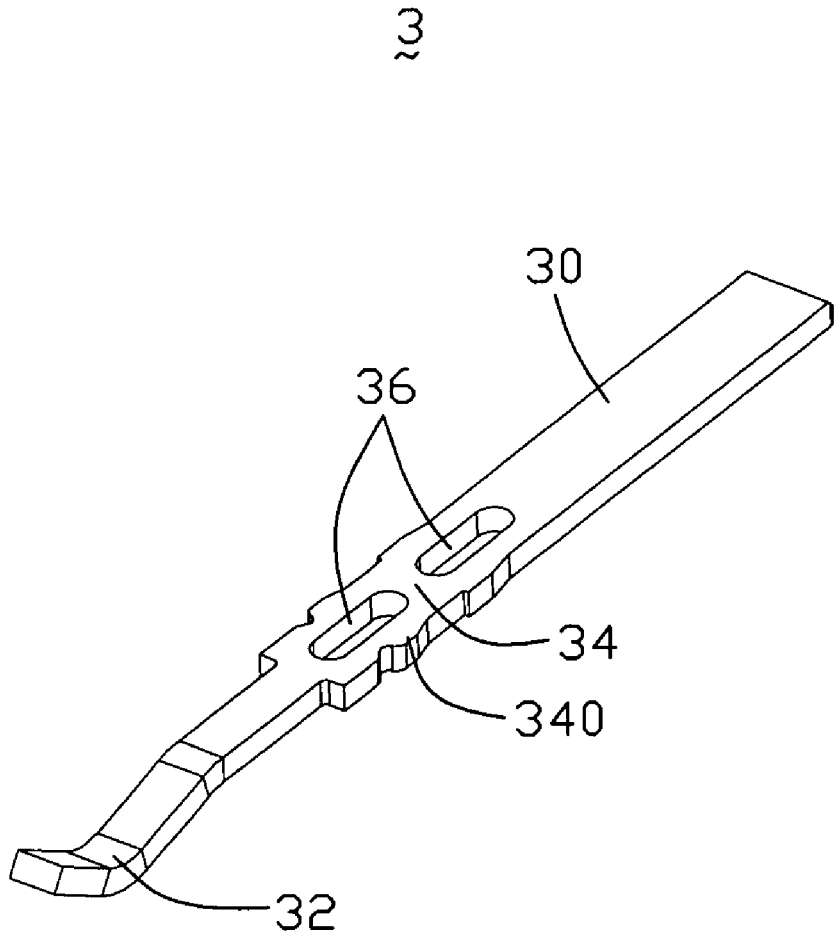
FIG. 4 is a perspective view of the conductive contact as shown in FIG. 2.

Referring to FIGS. 2-4 in conjunction, each dielectric housing 2 comprises a pair of arms 22 at the oppose ends, a pair of inner slots 220 in the inner lateral sides of the arms 22, a pair of outer slots 222 in the outer and rear side of the arms 22 and an elongate mating board 20 is adopted to engaging a slot in a complementary electrical connector (not shown).

Figure 5:
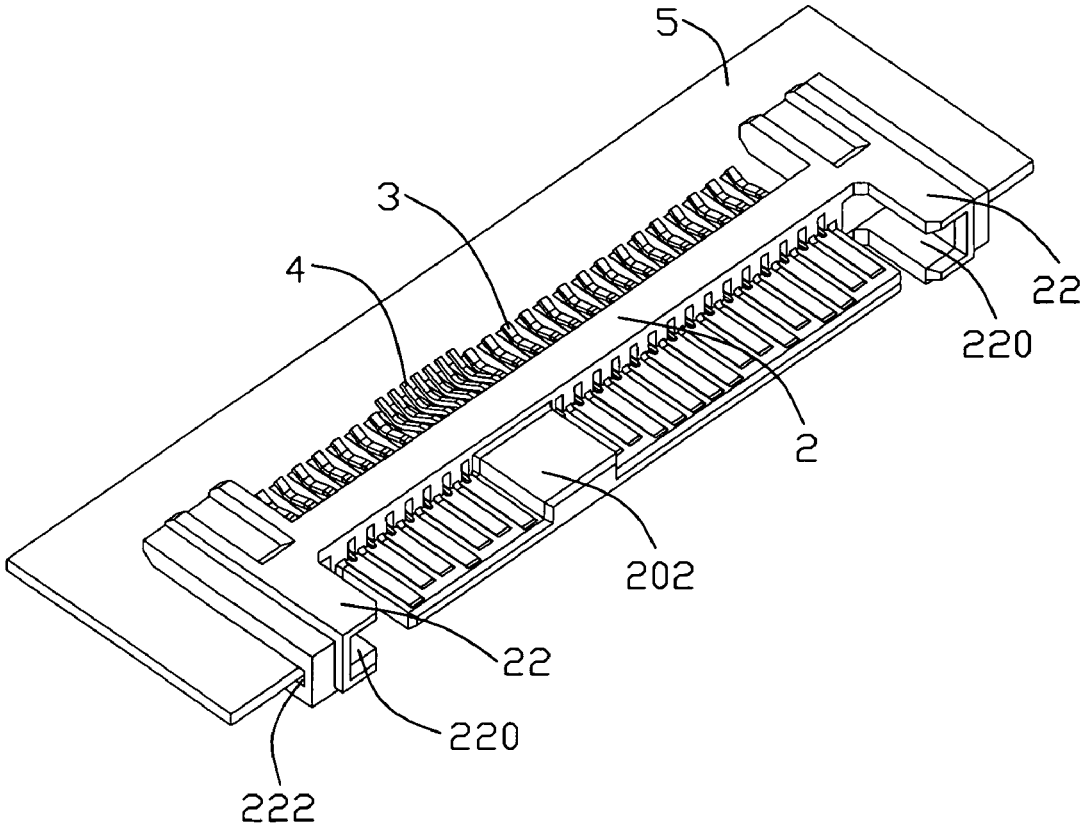
FIG. 5 is a perspective view of the electrical connector as shown in FIG. 1 mounted on a circuit board.

The pair of outer slots 222 defining a mounting surface (not labeled) for engaging a planar circuit board 5. Specially referring to FIG. 5, when the electrical connector 1 mounted, the printed circuit board 5 is sandwiched in the outer slots 222. The mating board 20 defining a planar mating plane (not labeled) parallel to the mounting surface (not labeled). Specially referring to FIG. 3, three recesses 200 are defined in a side opposed to the mating plane (not labeled). Three protrusions in a complementary electrical connector (not shown) can be locked in the three recesses 200 to keep the two mated electrical connectors in a stable position.

The plurality of conductive contacts 3 are respectively secured in the dielectric housing 2. Specially referring to FIG. 4, each conductive contact 3 comprises a planar contacting section 30 embedded in the dielectric housing 2 and having a contacting surface (not labeled) aligned with the mating plane (not labeled) and exposed to a complementary electrical connector (not shown) for electrically contacting, a mounting section 32 extending out from the dielectric housing 2 and bent to the mounting surface (not labeled), an intermediate section 34 connecting between the contacting section 30 and the mounting section 32. The intermediate section 34 defines some barbs 340 therebeside and two long holes 36 therein. The barbs 340 interfere with the dielectric housing 2 for securing the conductive contact 3 in certain position in the dielectric housing 2. The holes 36 reduce the area of the intermediate section 34 to gain a proper effective conductive region. The position of the hole 36 is adjacent to the barb 340 which can enhance the elasticity of the region where the barb 340 located on, so severe harm will not occur in the dielectric housing 2 due to the inference between the barb 340 and the dielectric housing 2.

The mating board 20 defines a block 202 standing on the mating plane (not labeled), a plurality of second conductive contacts 4 is extending on the side opposite to the block 202. The second conductive contacts 4 is thin, so they have a small area and do not need hole in them to reduce the area of the second conductive contact 4 to gain a small capacitance.

Figure 6:
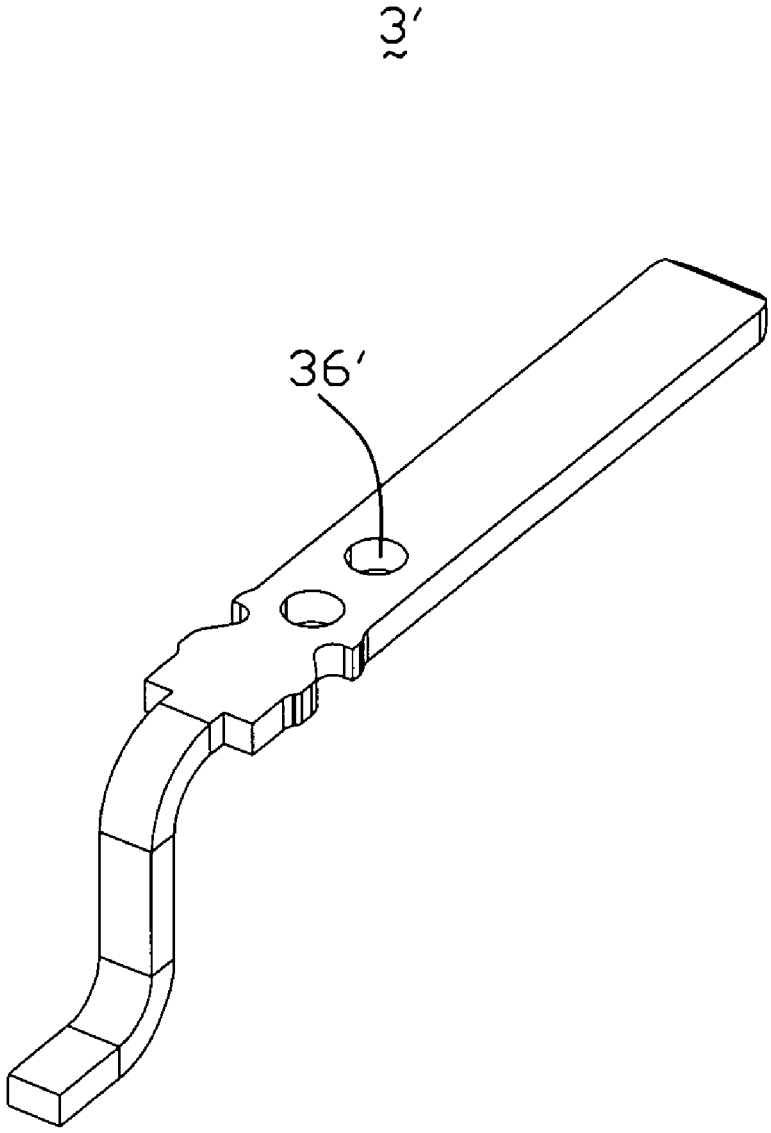
FIG. 6 is a perspective view of the conductive contact of a second embodiment of the present invention.

Referring to FIG. 6, the conductive contact 3' of a second embodiment of the present invention defines two circle shape holes 36' therein.

The first and second embodiment of the present invention illustrate conductive contacts 3, 3' defining two holes 36, 36', in fact, if the strength is enough strong, a conductive contact simply defining one hole is accepted. On the other hand, a conductive contact defining more than two holes is also accepted.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a dielectric housing comprises a pair of arms at the oppose ends, a pair of inner slots in the inner lateral sides of said arms, a pair of outer slots in said outer side and located at rear sides of said arms and an elongate mating board is engaged in said inner slots; and a printed circuit board is sandwiched in said outer slots, said mating board defining a planar mating plane parallel to a mounting surface of said pair of said outer slots; and a set of first conductive contacts aligned in a line and embedded securely in said dielectric housing, each first conductive contact comprising a planar contacting section having a contacting surface to electrically engage a complementary electrical connector, a mounting section to electrically engage said printed circuit board, an intermediate section connecting between the contacting section and the mounting section, the contacting surfaces of said plurality of first conductive contacts are located in both end sides of the housing and arranged a common plane having an offset from said printed circuit board; and a set of second contacts respectively secured in said dielectric housing and aligned in a line parallel to the line which said first conductive contacts aligned in, each second conductive contact having a thinner width than said first conductive contact;

wherein the intermediate section of each of said first conductive contacts defining a hole therein, to reduce an area of the intermediate section to gain a proper effective conductive region, said proper size conductive region of the intermediate section can be set by defining a proper size of said hole;

the mating board defines a block standing on a top side of said planar mating plane in series with said planar contacting sections of said first conductive contacts, said plurality of second planar contact sections of said second conductive contacts are embedded directly underneath the block, on a bottom side of said planar mating plane, opposite to said top side;

wherein at least one recess located on said top side of said planar mating plane to lock one protrusion of a complementary electrical connector during mating position.

2. The electrical connector as described in claim 1, wherein said intermediate section defines a barb there beside interfering with said dielectric housing, said hole is adjacent to the barb.

3. The electrical connector as described in claim 2, wherein said contacting sections of said first and second conductive contacts are exposed in said top and bottom sides of said mating board, respectively.

4. The electrical connector as described in claim 3, wherein two holes are defined in the intermediate section.

5. The electrical connector as described in claim 4, wherein the second conductive contacts are thin, so they have a small area and do not need hole in them to reduce the area of the second conductive contact to gain a small capacitance.

6. An electrical connector comprising:

a dielectric housing defining a mounting surface for engaging a planar circuit board, said planar circuit board is sandwiched in a pair of outer slots of said housing, a mating board defining a planar mating plane parallel to said mounting surface of said pair of said outer slots; and a plurality of conductive contacts respectively secured in said dielectric housing, each conductive contact comprising a planar contacting section embedded in said dielectric housing and having a contacting surface aligned with said mating plane and exposed to mate with a complementary electrical connector for electrically contacting, a mounting section extending out from said dielectric housing and bent to said mounting surface, an intermediate section connecting between the contacting section and the mounting section, and said plurality of conductive contacts comprising a first group of said conductive contacts and a second group of said conductive contacts; the mating board defines a block standing on a top side of said planar mating plane in series with said planar contacting sections of said first group conductive contacts, said plurality of second planar contact sections of said second group conductive contacts are embedded directly underneath the block, on a bottom side of said planar mating plane opposite to said top side;

a hole defined in the intermediate section of each conductive contacts of said first group conductive contacts to reduce the area of the intermediate section to gain a proper conductive region; said intermediate section of said second group conductive contacts are thinner than said intermediate section of said first group conductive contacts, therefore said intermediate section of said second group conductive contacts do not need holes;

wherein at least one recess located on said top side of said planar mating plane to lock one protrusion of a complementary electrical connector during mating position.

7. The electrical connector as described in claim 6, wherein said intermediate section defines a barb interfering with said dielectric housing, said hole is adjacent to the barb.

8. The electrical connector as described in claim 6, wherein two holes are defined in the intermediate section.

* * * * *